United States Patent [19]

Newman et al.

[11] Patent Number: 4,832,202

[45] Date of Patent: May 23, 1989

[54] CONTAINERS

[75] Inventors: Alec T. Newman; David Rhodes; Bryan C. Lack, all of Banbury, United Kingdom

[73] Assignee: General Foods Limited, Banbury, England

[21] Appl. No.: 51,660

[22] Filed: May 19, 1987

[30] Foreign Application Priority Data

May 22, 1986 [GB] United Kingdom ..... 8612537

[51] Int. Cl.[4] ..... B65D 21/02

[52] U.S. Cl. ..... 206/519; 206/217; 229/1.5 B

[58] Field of Search ..... 229/1.5 B; 206/217, 206/515, 519, 520

[56] References Cited

U.S. PATENT DOCUMENTS

| | | | |
|---|---|---|---|
| 3,122,264 | 2/1964 | Davis | 206/515 |
| 3,227,273 | 1/1966 | Syverson | 206/217 |
| 4,096,947 | 1/1978 | Morse | 206/217 |
| 4,193,494 | 3/1980 | Green | 206/217 |
| 4,231,476 | 11/1980 | Compton | 206/217 |
| 4,420,081 | 12/1983 | Dart | 206/519 |

FOREIGN PATENT DOCUMENTS

| | | | |
|---|---|---|---|
| 2445135 | 8/1980 | France | 206/217 |
| 1096451 | 12/1967 | United Kingdom . | |
| 1366310 | 9/1974 | United Kingdom . | |
| 1427715 | 3/1976 | United Kingdom . | |
| 1525133 | 9/1978 | United Kingdom . | |
| 1544223 | 4/1979 | United Kingdom . | |
| 1545579 | 5/1979 | United Kingdom . | |
| 1545580 | 5/1979 | United Kingdom . | |
| 1564097 | 4/1980 | United Kingdom . | |
| 1585191 | 2/1981 | United Kingdom . | |

*Primary Examiner*—George E. Lowrance

*Attorney, Agent, or Firm*—Linn I. Grim; Daniel J. Donovan

[57] ABSTRACT

A nestable container which is constructed so that when formed into a stack the ribs formed in the outer surface of one container rest on an inner shoulder of the container below it in the stack, the angle of inclination of the ribs being the same as the angle of inclination of the inner surface of the side wall portion which it abuts of the container below it in the stack, and the outer surface of one container adjacent to the base engaging the inner surface of the side wall portion of the container below it in the stack to form a powder seal. The cups when nested together to form a stack are freely rotatable one inside the other.

8 Claims, 2 Drawing Sheets

CONTAINERS

Figure 1:
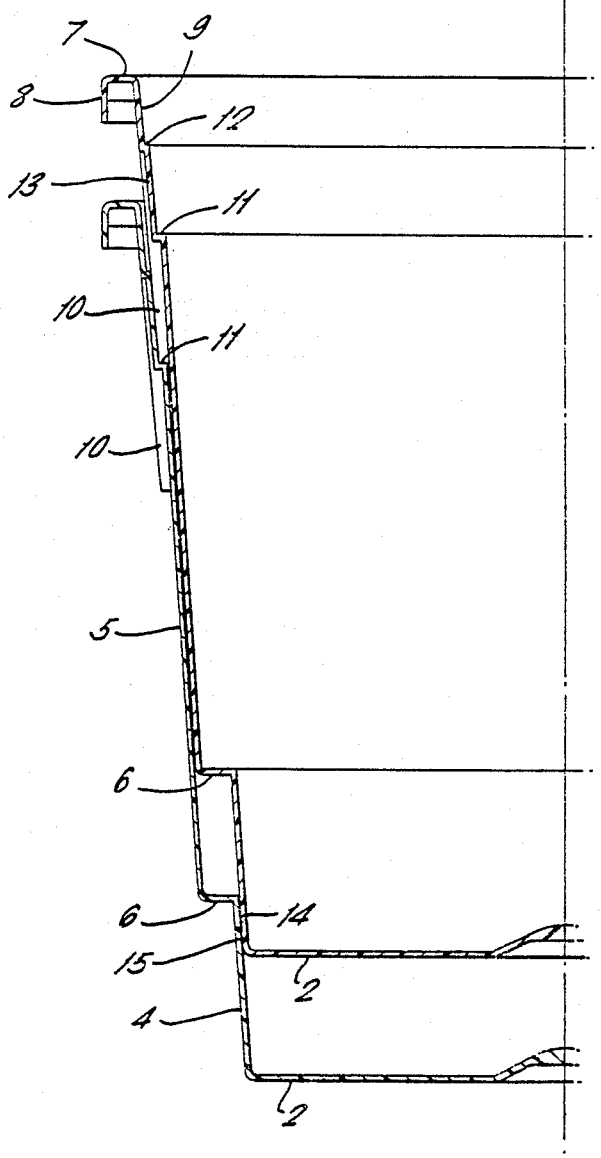

The present invention relates to containers and, in particular, to drinking cups which are used in the consumption and/or sale of hot or cold beverages. Drinking cups of this type may be used in vending machines and may be nested one inside another to form a stack. The bases of each pair of adjacent cups in the stack are spaced apart and the spaces may be filled with dry beverage ingredients. The dry beverage ingredients are then reconstituted with hot or cold water to make the desired beverage.

Cups of this type may be used in automatic vending machines in which an individual cup is separated from a stack of similar cups and then automatically filled with water to make the desired beverage. It will be appreciated that such cups may also be used at home where a cup is separated from a stack of similar cups and filled by hand with water.

Containers which can be nested together to form a stack are known, but many of the stacks so-formed suffer from the disadvantage that they telescope or jam under a vertical load. It has been proposed, for example, to provide a container with an annular projection on one surface thereof and an annular groove on the other surface thereof, the projection and groove being positioned so that when the containers are formed into a stack the annular projection on one container interlocks with the annular groove of the adjacent container. It has also been proposed to provide cups with upper and lower stacking surfaces such that when stacked together the lower stacking surface of one cup sits on the upper stacking surface of the cup below it in the stack.

We have now developed a container which has an alternative arrangement of stacking features for holding the containers together in a stack.

Accordingly, the present invention provides a nestable container comprising a base and a side wall integral with and upstanding from the base to define therewith a reservoir for liquid, the side wall diverging generally upwardly from the base and having a lower portion and an upper portion, the lower side wall portion and upper side wall portion being joined together by a first annular shoulder and the upper side wall portion terminating at its top in a rim, the upper side wall portion of the container having disposed on the outer surface thereof a plurality of spaced apart axially extending ribs and the upper side wall portion having a second annular shoulder formed in the inner surface thereof, so that when formed into a stack the ribs on the outer surface of one container rest on the inner second shoulder of the container below it in the stack, the angle of inclination of the said ribs being the same as the angle of inclination of the inner surface of the upper side wall portion above the second shoulder, a powder seal being formed by the outer surface of the lower side wall portion of one container adjacent the base engaging the inner surface of the lower side wall portion of the container below it in the stack adjacent the first annular shoulder, and the cups when nested together to form a stack being freely rotatable one inside the other.

The containers of the present invention are preferably cups which will generally be formed from a thermoplastics material. Whilst any thermoplastics material may be used to form the containers, currently commercially suitable materials include polystyrene, acrylonitrile/butadiene/styrene, and polypropylene resins, optionally filled with, for example, chalk or talc for additional strength. Barrier resins or laminates/coextrusions may be used to improve the shelf life of the beverage ingredients.

The containers of the present invention are designed to be nested together and thus may readily be formed into a stack thereof. The top container in such a stack may be provided with a plug or snap-on cap to retain the beverage ingredients in the cup. The stack may be wrapped and in this instance a plug is to be preferred to a snap-on cap since the plug allows the enveloping film to be drawn into the top aperture region of the stack and enables adequate top pressure to be obtained. The use of a plug also prevents deformation of the top container in the stack. A cap is, however, also acceptable and could be cheaper to manufacture than a plug. It has also been found that by using thin thermoformable sheet a shallow cap is deformed under vacuum to form an aperture into which enveloping film is drawn. Certain methods of wrapping are described in British Pat. No. 1539729. Any other methods of wrapping the cups may also be used which retain the cups in engagement during the wrapping operation.

The ribs formed in the outer surface of the container are preferably so positioned towards the top of the containers that they also serve to provide additional insulation where the container is gripped by the user so that the container can be held easily and comfortably when it contains a hot beverage. The ribs also provide a gripping surface which enables the container to be held in the hand of the user without slipping through the fingers.

The external angle of inclination of the ribs to the vertical is the same as the angle of inclination of the inner surface of the upper portion of the side wall above the second annular shoulder. This feature provides the diametrical overlap between the bottom of the ribs and the surface of the second annular shoulder. When the containers are nested in a stack the ribs on one container about the portion of the upper side wall of the container below it in the stack above the second annular shoulder. There is, however, no frictional engagement and the cups can be freely rotated one inside the other.

Figure 2:
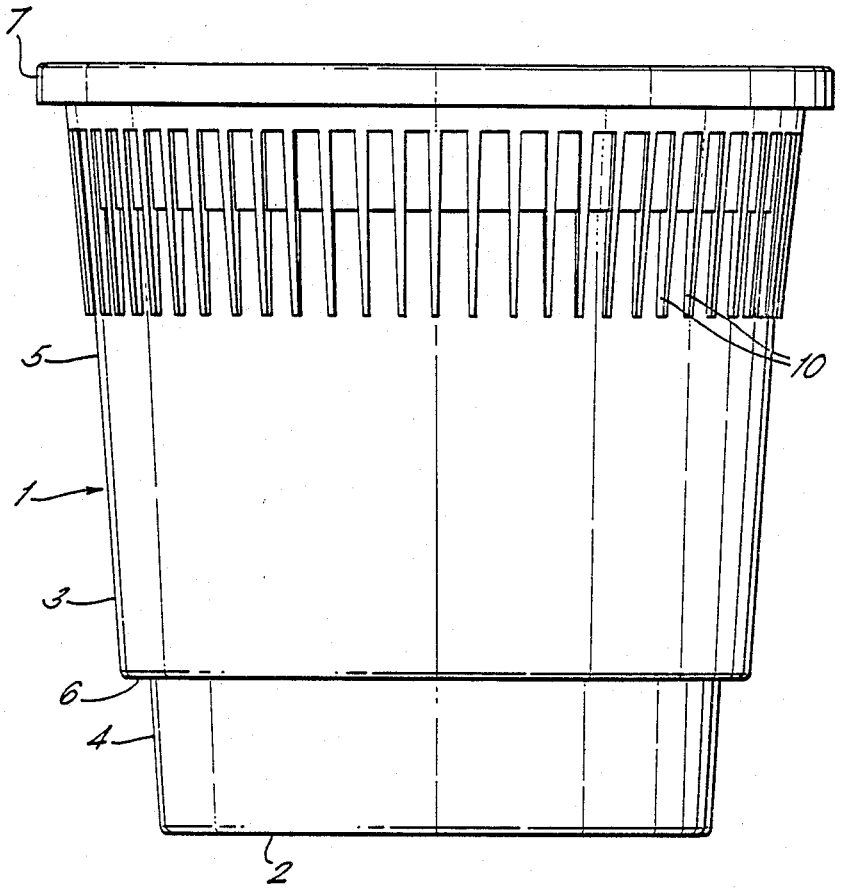

The present invention will be further described with reference to the accompanying drawings, in which:

FIG. 1 is a part cross-sectional view through nested cups in accordance with the invention; and FIG. 2 is a side elevation of a cup in accordance with the invention.

Referring to the drawings, each cup is generally indicated at 1 and has an essentially circular base 2. The base 2 has an upstanding side wall 3 formed integrally therewith. The side wall has a lower portion 4 and an upper portion 5 which are joined together by a first annular shoulder 6. The free end of upper side wall portion 5 is turned over to form a rim 7 which may be strengthened by means of struts or flanges (not shown) which project between the turned down portion 8 of the rim and the adjacent part 9 of the upper side wall portion. The upper side wall portion 5 has a plurality of spaced apart axially extending ribs 10 formed therein. In the embodiment as shown in FIG. 2, sixty ribs 10 are provided on the upper side wall portion of the cup. A second shoulder 11 is formed in the upper portion of the side wall. The cups nest together to form a stack by the ribs 10 formed on one cup resting on the second shoulder 11 formed in the inner surface of the upper side wall portion of the cup below it in the stack. A relatively slight third annular shoulder 12 is formed in the upper side wall portion, the ribs 10 ending at this point. This third shoulder helps to provide the cups of the invention with additional rigidity. The angle of inclination to the vertical of the ribs 10 is the same as the angle of inclination to the vertical of the portion 13 of the upper side wall above shoulder 11. This feature provides the diametrical overlap between the bottom of the ribs and the second shoulder 11.

A powder seal is formed by the portion 14 of the outer surface of the lower side wall portion adjacent the base of one cup engaging the portion 15 of the inner surface of the cup below it in the stack. The powder seal between adjacent cups provides a space for dry beverage ingredients to be pre-packed therein. The powder seal also prevents the displacement of the beverage ingredients from the base of the cups. As cups are removed from a stack thereof, the ingredients of the beverage are present in the bottom of the cup, ready for the addition of hot or cold water in a manner known per se.

We claim:

1. A nestable container which consists essentially of:

a base;

a side wall integral with and upstanding from the base to define with the said base a reservoir for liquid, the side wall diverging generally upwardly from the base;

a lower side wall portion and an upper side wall portion, a first annular shoulder which joins together said lower side wall portion and said upper side wall portion;

a second annular shoulder, essentially horizontal, formed in the inner surface of said upper side wall portion;

a rim on top of said upper side wall;

a plurality of spaced apart axially extending ribs disposed on the outer surface of the upper side wall portion and extending said ribs on said outer surface below the level of said inner second annular shoulder;

said annular shoulder formed in the inner surface of the said upper side wall portion so that when formed into a stack the ribs on the outer surface of one container rest on the inner second shoulder of the container below it in the stack, the angle of inclination of the said ribs being the same as the angle of inclination of the of inner surface of the upper side wall portion above the second shoulder, the outer surface of the lower side wall portion of one container adjacent the base engaging the inner surface of the lower side wall portion of the container below it in the stack adjacent the first annular shoulder thereby to form a powder seal, and the cups when nested together to form a stack being freely rotatable one inside the other.

2. Container according to claim 1 which is formed from a thermoplastics material.

3. Container according to claim 2 wherein the thermoplastics material is polystyrene, preferably acrylonitrile/butadiene/styrene or polypropylene.

4. Container according to claim 1 which has sixty axially extending ribs equidistantly spaced around the upper side wall portion of the container.

5. A stack of containers which consists of a plurality of containers as claimed in claim 1 nested together.

6. Stack of containers according to claim 5 wherein the top container of the stack is provided with a plug or snap-on cap.

7. Stack of containers according to claim 5 wherein the bottom of each container in the stack contains beverage ingredients.

8. Stack of containers according to claim 5 which is wrapped with a sheet material.

* * * * *